United States Patent [19]

Russell, Jr.

[11] Patent Number: 4,899,680

[45] Date of Patent: Feb. 13, 1990

[54] BOAT MOORING DEVICE AND METHOD OF USING SAME

[76] Inventor: Alexander I. Russell, Jr., 631 S. 9 St., Broken Bow, Nebr. 68822

[21] Appl. No.: 197,768

[22] Filed: May 23, 1988

[51] Int. Cl.[4] ..... B03B 21/04

[52] U.S. Cl. ..... 114/230; 24/129 R; 294/82.11

[58] Field of Search ..... 114/230, 218, 221 R; 24/129 R, 129 C, 128, 131 R; 119/109, 118; 410/101, 116; 294/821, 82.11; 403/405.1, 410

[56] References Cited

U.S. PATENT DOCUMENTS

| | | | |
|---|---|---|---|
| 234,011 | 11/1880 | Fish | 24/129 R |
| 376,595 | 1/1888 | Hawley | 24/131 R |
| 424,560 | 4/1890 | Leiter | 24/129 R |
| 1,441,737 | 1/1923 | Mickelson | 24/129 R |
| 2,329,389 | 9/1943 | Bullum | 24/129 R |
| 2,441,336 | 5/1948 | Sova | 410/101 |
| 2,892,230 | 6/1959 | Lopez | 24/129 R |
| 3,215,390 | 11/1965 | DeShetler | 410/116 |
| 3,703,875 | 11/1972 | Gunvalson | 114/230 |

FOREIGN PATENT DOCUMENTS

| | | | |
|---|---|---|---|
| 166728 | 12/1954 | Australia | 24/129 R |
| 114636 | 8/1942 | Norway | 294/82.1 |

*Primary Examiner*—Sherman D. Basinger
*Assistant Examiner*—Thomas J. Brahan
*Attorney, Agent, or Firm*—Bernard L. Kleinke; William P. Waters; Jerry R. Potts

[57] ABSTRACT

A boat mooring device, and a method of using it, includes a first shank member, having an axial protuberance thereon and three integrally connected cross arm members, and a second shank member having an axial protuberance thereon, a pair of parallel spaced apart cross arms, one at the end of said second shank member, and a U-shaped yoke disposed at the opposite end of said second shank member for releasably receiving the first shank member, and a mooring line attached to a boat.

13 Claims, 3 Drawing Sheets

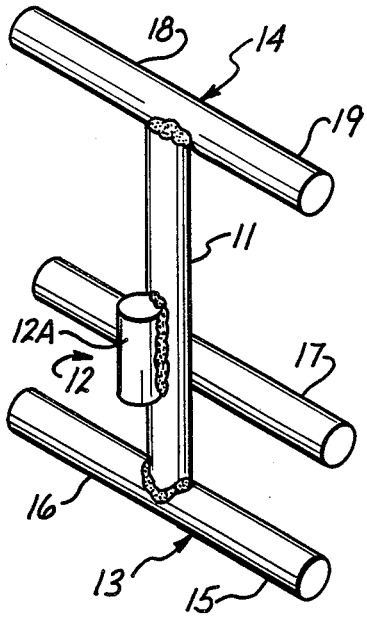
FIG. 1
FIG. 2
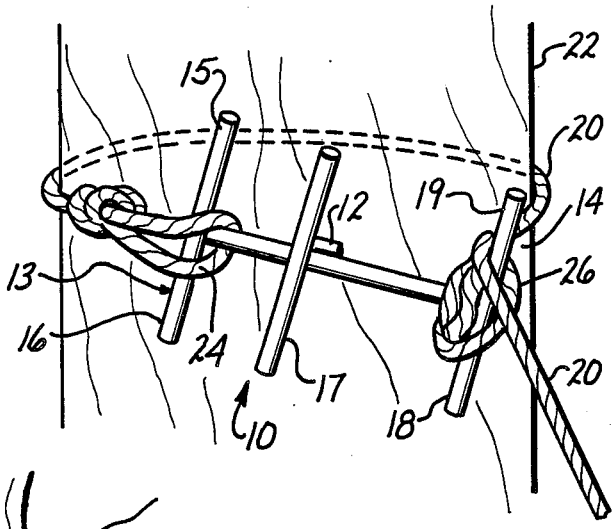
FIG. 3
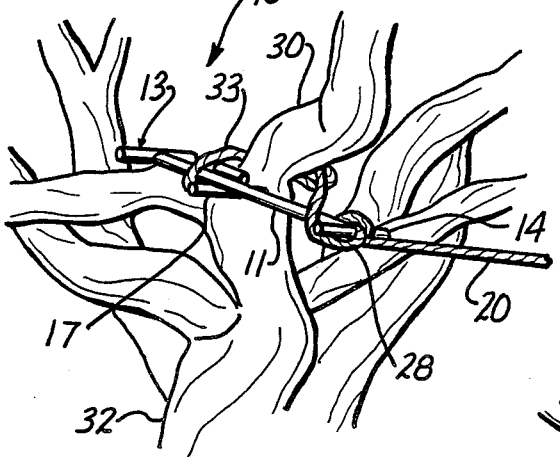
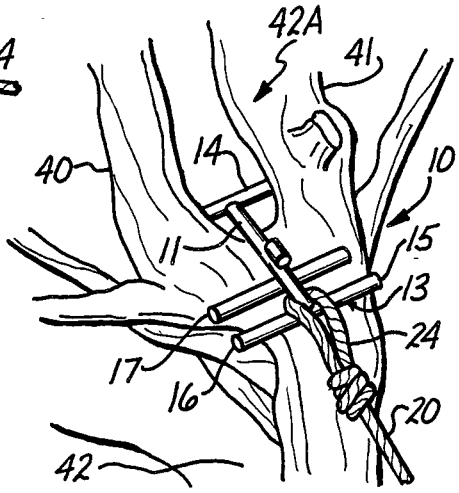
FIG. 4

BOAT MOORING DEVICE AND METHOD OF USING SAME

DESCRIPTION

1. Technical Field

The present invention relates in general to a boat mooring device as well as a method of using it for boat mooring purposes. More particularly, the invention relates to the mooring device itself, which enables a variety of anchoring techniques to be used to fix a boat in a stationary position.

2. Background Art

Boat mooring devices of various types and kinds have been known in the art. Typically such devices include an anchor which is secured to a dock by means of a member or wedge by attachment to the planks of a dock. Such devices have been limited in their use to docks with open plank slots and are limited in use by virtue of their design.

Additionally, prior known mooring devices have been limited to devices employing griping mechanisms, because wind and wave action causes other type devices to become easily dislodged. Such devices usually include mechanisms with moving parts, which either break after repeated use, or easily corrode due to their exposure to the elements of nature.

Therefore, it would be highly desirable to have a device that may be used in a variety of locations, and which would not require a mechanical gripping mechanism with moving parts.

A mooring device employing a gripping mechanism has been described in U.S. Pat. No. 4,297,963. The described device includes a body in the form of a T-bar made up of a shaft and elongated head. A plate is slidably mounted on the shaft with its plane parallel to the head to provide an adjustable, uniform space between confronting surfaces of the head and the plate. The body is rotatable with respect to the plate, about an axis perpendicular to the plane of the plate. A compression spring is positioned circumscribing the shaft and is located between the plate and a knurled nut adjustably positioned on the shaft near its face and on threads Tension on the spring is adjustable by moving the knurled nut so that an appropriate amount of pressure for various thicknesses of docking may be achieved A ring is secured to the free end of the shaft to which a line from a boat may be tied.

This device has several disadvantages. First, its use is limited to a dock with planks Thus, it could not be used to moor a boat to a tree or other upright structure. Secondly, due to the moving parts, the device is subject to malfunction. (The knurled nut can become separated from the shaft and lost or misplaced, or corroded due to exposure to weather conditions and sea water.

It would therefore be highly desirable to have a device which would be more versatile to use, and yet without moving parts to avoid mechanical failures and lost parts or parts becoming unusable through corrosion.

A mooring device of simple one piece construction, without a gripping mechanism, has been described in U.S. Pat. No. 3,703,875. The described device is intended for use with piers having planking members or metal sections which are spaced about 1 to 2 inches apart. The device comprises a main body section or shank having a pair of elongated outer arm sections which extend laterally from the outer end portion of the shank in diametrically opposite directions. The lower arm sections are provided with flat or planar inner surfaces adapted to engage a flat surface of a planking member of a pier and are elongated so as to distribute the force applied to the mooring device by a mooring line over a relatively large surface area of the planking member.

Spaced inwardly from the outer arm sections are inner arm sections extending laterally in an opposite direction from the shank, with the inner arm section disposed in the same plane with the inner arm sections The length of the inner arm sections are preferably no more than about half the length of the arm sections, but always have a combined length greater than the distance between the spaced apart planking members forming a pier or dock. The outer surface of the inner arm sections are also preferably planar and are adapted to engage the opposite surface of the planking members which form the walkway from that engaged by the lower arm section planar surfaces. The spacing between the outer arm section and the inner arm section is slightly greater than the thickness of the planking. The inner end of the shank is provided with a ring or eye section adapted to have a mooring line attached thereto. The outer arm section and the outer portion of the shank which extends outwardly of the inner arm sections has a main inner transverse with less than the spacing between the planking members to permit inserting the outer arm members and said out portion of the shank between the spaced planking members.

This device has several disadvantages. Firstly, to use the device, a mooring line must be tied to the device thereby creating a knot in the rope. Thus, when the device and line are exposed to water, the knot can become extremely tight and difficult to untie. Secondly, because the surfaces of the device are flat, the device is not easily secured to a vertical upright surface.

Therefore, it would be highly desirable to have a device that would not require a mooring line knot to be tied to the device, and that could be easily attached to a variety of upright surface.

Other tie down mechanisms are disclosed in U.S. Pat. Nos. 849,023, and 3,351,356, which mechanisms exhibit the same and similar disadvantages as previously discussed.

It would also be highly desirable to have such a device, which does not employ moving parts, and which is adapted to facilitate the locking of the mooring line to a stationary object.

DISCLOSURE OF INVENTION

The principal object of the current invention is to provide a new, improved versatile boat mooring device, as well as a method of using same, useful in enabling a wide variety of anchoring techniques to fix a boat in a stationary position.

Another object of the current invention is to provide such a device which can be used by a person in a wide variety of locations, and which would be relatively inexpensive to manufacture and easy to use.

Another object of the present invention is to provide a device which, enables a boat to be locked securely in a stationary mooring position in a relatively easy and simple manner.

Briefly, the above and further objects of the present invention are realized by providing a mooring device and method of using to eliminate the need for any moving mechanical parts. The device can be secured in a wide variety of locations, and can even be locked in place for security purposes.

Such a mooring device includes a first shank member with an axial protuberance thereon and having three integrally connected cross members Two of said cross members are fixed at diametrically opposite ends of the shank member, while the third intermediate cross member extends parallel to the oppositely opposed members and is disposed at a spaced apart relation closer to one of the oppositely opposed members than the other. The axial protuberance on the shank comprises a short longitudinal rod fixed to the shank member and directly opposite the intermediate cross member.

In use, the cross members of the device are oriented to slip through the openings in the planks of a boat dock or grating, and then lowered so that one of the cross members disposed on the end of the shank member is below the lower surface of the plank, while the intermediate cross member is above the upper surface of the plank. Once the device is oriented in this position, it is then rotated about its shank axially through 90 degrees to secure the plank between the cross members. A loop of a mooring line, such as a rope, for mooring a boat, is then secured to the end cross member to secure the boat.

For greater security, in another form of the present invention, the device includes a first shank member with an axial protuberance thereon. Three integrally connected cross members extend from the shank member, wherein two of the cross members are fixed at diametrically opposite ends of the shank with a third intermediate member extending parallel to the other member but disposed at a spaced apart relation closer to one member than the other. The axial protuberance of the first shank member is positioned directly opposite the intermediate cross member. The device further includes a second shank member having an axial protuberance thereon and a yoke at one end adapted to receive the first shank member and at the opposite end thereof outer arm sections. The second shank member further includes an inner arm section that is spaced apart from the outer arm section.

The method of using the two shanks together includes inserting the outer arm sections of both shanks through the opening in the planks of a boat dock or other such stationary support surface, and then rotating both shanks axially through about 90° , to secure them to opposite sides of the plank. The first shank member is then placed in the yoke of the second shank member. A lock, such as a shank of a conventional padlock, is then inserted into the yoke, after securing a mooring line thereto restraining the boat in a secure manner to help prevent theft of the boat.

The current invention is useful as a temporary mooring device, and as compared to previously known devices, provides several advantages. Firstly, it is fully versatile in that it can be used in a variety of locations. For example, the inventive device can be attached to walkway plankings, piers and even to trees and other upright structures There are no moving parts, or it does not require tying of knots to the device itself.

The device is practical in that it can be easily stored in a conventional recreational boat, is light in weight, and does not require assembling or adjustments. Moreover, the device can be locked in place for security purposes. It is easily used, reliable, and may be constructed of a suitable material so that it will not corrode.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 1 is a pictorial view of a mooring device constructed in accordance with the present invention;

FIG. 2 is a pictorial view of the mooring device of FIG. 1, illustrating the device for helping secure a mooring lining about a stationary post;

FIG. 3 is a pictorial view of the mooring device of FIG. 1, illustrating it helping secure a mooring line looped about a tree branch;

FIG. 4 is a pictorial view of the mooring device of FIG. 1, illustrating the device being wedged between the branches of a tree, for the purpose of securing the end of a mooring line to the tree branch;

BEST MODE FOR CARRYING OUT THE INVENTION

Figure 5:
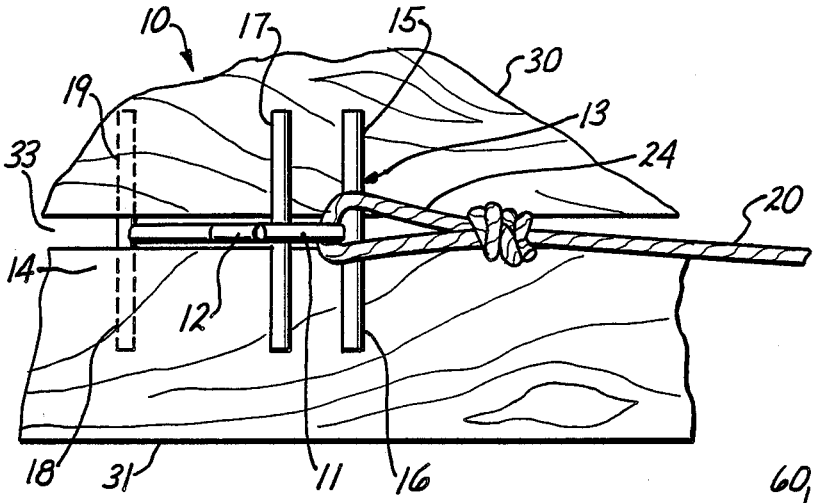
FIG. 5 is a plan view of the mooring device of FIG. 1, illustrating it secured to a pier.

Referring now to the drawings and more particularly to FIGS. 1–6 thereof, there is shown a new improved mooring device 10 which is constructed in accordance with the present invention. The device 10 may be used to secure a mooring line 20 of a boat (not shown) to a variety of fixed stationary objects, for tethering it in place.

As best seen in FIG. 1, the mooring device 10 is of a unitary construction of any suitable noncorrosive material, such as aluminum or other material. The device 10 generally comprises an elongated shank member 11 having thereon an axial protuberance generally indicated at 12, in the form of a short longitudinal rod member 12A. Two elongated cross members 13 and 14, fixed transversely on opposite ends of the shank member 11 forming inner arm sections 15 and 16 and outer arm sections 18 and 19 extending laterally and in diametrically opposing directions from the shank member. A center or intermediate cross arm member 17 is fixed to and extends transversely to the shank member 11. Each one of the cross members 13 and 14 are identical to one another, and have an axial length which is substantially equal to the length of the shank member 11. Thus, except for the protuberance 12, the device 10 comprises four like members, which are fixed together by any suitable technique, such as welding. Therefore, there is a cost efficient manner of making the device 12 out of rod stock by cutting it to uniform lengths, because substantially all of the parts are identical and thus are interchangeable. They are efficient to manufacture and inventory.

While this manufacturing technique is preferred, other techniques can also be employed For example, the device can be made of a suitable one-piece construction, such as by a metal casting process.

Referring now to FIG. 1, the shank member 11 is generally a body section of uniform cross sectional thickness, which is circular in cross section throughout its length, with the axial protuberance 12 affixed thereto by any suitable technique, such as welding. The protuberance 12 is disposed opposite the cross member 17, and functions to engage a circular or curved support structure, such as the post 22 of FIG. 2, so that it grips the support object frictionally. In such an arrangement, as pressure is applied to device 10 through the mooring line 20 the protuberance 12 helps fix removably device 10 against the support structure, to prevent or restrain unwanted relative movement of the device 10 relative to the support structure.

The ends of shank member 11 terminates in the cross members 13 and 14 respectively. The cross member 13 is generally a body section of uniform cross sectional thickness which is circular in its cross sectional area. Cross member 13 is fixed by welding at the terminal end of shank member 12 and extends in a diametrically opposite direction from its center to form a T shape, with a pair of outer arms 15 and 16. The opposite end of the shank member 11 terminates in cross member 14 which extends laterally therefrom in diametrically opposing directions forming inner arm sections 18 and 19.

The center cross arm member 17 extends perpendicularly to the shank member 11, and is disposed in a parallel spaced-apart manner to the members 13 and 14. The member 17 is disposed in a spaced-apart relationship, closer to member 13 than member 14 The cross arm member 17 is fixed to the surface of the shank 11, diametrically opposite the protuberance 12, and extends laterally from the shank 11 parallel to the outer arm sections 15 and 16.

The short longitudinal rod or member 12A extends axially along the longitudinal axis from the surface of shank 11 and generally diametrically opposite to the center of the horizontal and vertical axis of the center cross arm member 17 forming the protuberance 12 thereon. The rod 12A is generally of uniform cross sectional thickness throughout its length, and is circular in cross sectional area.

Referring now to FIG. 2, the mooring device 10 is shown with a mooring line 20 having at its end a loop 24 surrounding the outer arms 15 and 16 and shank member 11. Mooring line 20 is further looped around a pier piling or similar post 22 and then between shank member 11 and outer arm section 18 and back under then over arm 19 to form a loop 26 with the device 10 to encircle the post 22. In this manner, when mooring line 20 is pulled, it applies a force which is transferred through cross member 13, and shank member 11 to the piling 22, thereby positioning the device 10 against the upright post 22 with its short longitudinal member 12A pressed forceably against the surface of the post 22. With the protuberance 12 pressed against the surface of the piling 22, the cross arm 14 is raised upwardly and away from the post 22 so that mooring line 20 easily wrapped about the outer arms 18 and 19 as illustrated in FIG. 2, to help form the loop 26.

It should therefore be clear that the protuberance on shank member 11 formed by the short longitudinal rod 12A, enables the mooring device 10 to be secured in a position against piling post 22 and not slide or fall under the force of gravity downwardly along the post, even if the pulling force on the mooring line 20 temporarily ceases and the mooring line becomes slack, due to the boat floating in the water.

Figure 6:
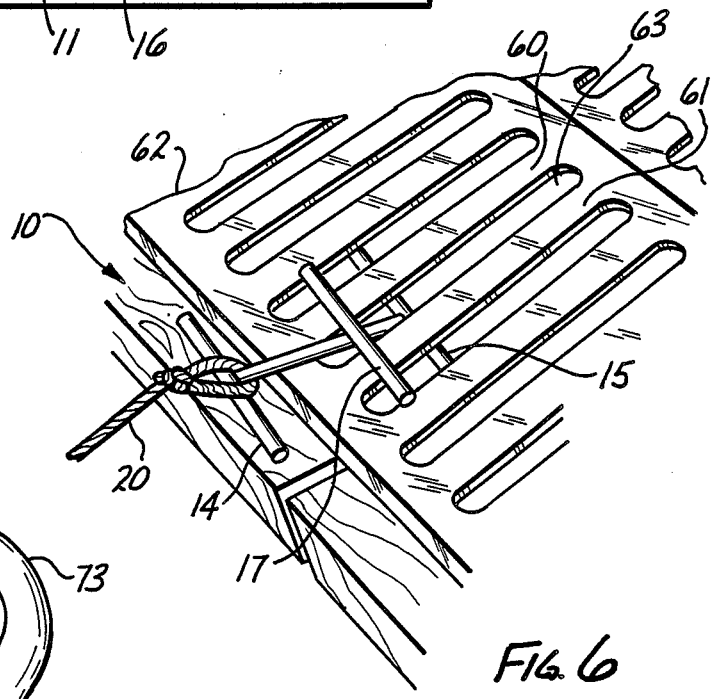
FIG. 6 is a pictorial view of the mooring device of FIG. 1, illustrating it wedged securely to a grating.

FIGS. 3, 4, and 6 illustrate still other optional methods of using the mooring device 10. In FIG. 3, the mooring device 10 is shown secured to a branch 30 of a tree 32. In this arrangement a loop 33 at the end of mooring line 20 is wrapped about the cross arm 13, and the shank member 11, so it may be pulled to apply a force which is transferred through the shank member 11 to the branch 30. In this manner, the branch 30 is disposed between cross member 13 and cross member 17. The mooring line 20 is further wrapped around shank member 11, and the cross member 14 to form a loop 28. In this manner, mooring line 20 may be pulled to secure the device 10 to the tree 32.

For larger branches, the cross member 14 and cross member 17 can be utilized in lieu of cross member 13 and the cross member 17 as the spacing between members 14 and 17 is larger than the spacing between members 13 and 17. It should be noted that in this arrangement, the short longitudinal rod 12A does not engage the branch, thereby allowing a greater force to be transferred against the branch by the shank member 11.

In FIG. 4, the mooring device 10 is shown held between two branches 40 and 41 in the fork 42A of a tree 42. In this arrangement, the mooring device 10 is used by holding the device 10 between the branches 40 and 41, with all its cross arms extending parallel to the branches 40 and 41. Once the device 10 is so oriented, the shank member 11 extends between the branches 40 and 41 forming the fork 42A with the end member 14 positioned behind the branches 40 and 41. Once the shank is in position, it is then rotated 90° so that cross member 14 extends transversely to the surfaces of branches 41 and 42. The mooring line 20 with its loop 24 is then attached to the cross member 13 and pulled so the pulling force is transferred through the member 11 to the end member 14 to cause the member 14 to firmly engage the back side of the two branches 40 and 41 of the tree 42.

Referring now to FIG. 5, in connection with the attachment of the device 10 to the planks 30 and 31 of a pier, the operation of the present invention will now be described. In use, the mooring device 10 of the present invention is preferably held directly above the space 33 between adjacent planks 30 and 31 and then lowered until end member 14 is below the lower surface of planks 30 and 31 and the center cross member 17 is above the upper surface of planks 30 and 31. A mooring device 10 is then rotated 90° about its axis so that members 14 extend transversely across the lower surface of planks 30 and 31 and cross member 17 extends transversely across the upper surface of planks 30 and 31. A mooring line 20 with a loop 24 is then looped around the outer arm sections 15 and 16 and the shank member 11. A pulling force is then applied on the mooring line 20 which is transferred to the member 11 and member 13 to members 14 and 17 and to the planks 30 and 31 thereby securing the device to the planks.

Referring now to FIG. 6, an alternate method of operation of the present invention will be described. In FIG. 6, the mooring device 10 is shown secured to a grating. In use, the mooring device 10 is held above the space 63 between adjacent grates 60 and 61 with all its cross members 13, 14 and 17 extending parallel to the grates 60 and 61. The mooring device 10 is then slid through and between the grate opening 63 until cross member 13 extends below the lower surface of grates 60 and 61 and cross member 17 is above the upper surfaces of grates 60 and 61. The mooring device is then rotated 90° above its axis so that the cross member 13 and cross member 17 extend perpendicular to the longitudinal axis of the grates 60 and 61. In this position, member 13 engages the lower surface of the grates and extends across or bridges the opening 63 between the grates 60 and 61, while member 17 engages the upper surface of the grates and extends across or bridges opening 63 preventing the mooring device 10 from falling through the opening 63 between the grates 60 and 61. A mooring line 20 is then looped around the T-bar formed by shank 11 and cross member 14 to secure a boat attached thereto to the grating.

Figure 7:
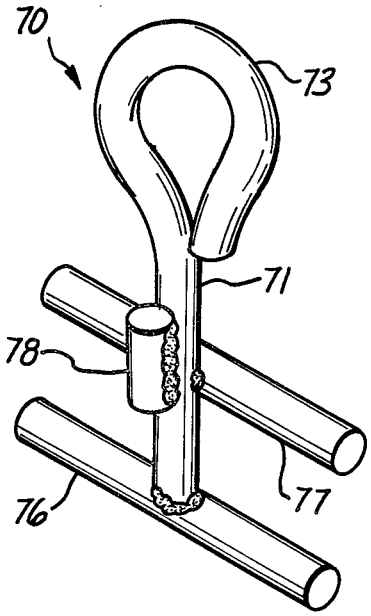
FIG. 7 is a pictorial view of another moor device, which is also constructed in accordance with the invention.

FIG. 7 illustrates a mooring device 70, which is also constructed according to the present invention. The device 70 includes a shank member 71 having an axial protuberance thereon comprised of a short longitudinal member 78, and a loop 73 at one end thereof and an elongated end member 76 at the opposite end thereof. A cross arm member 77 is disposed on the surface of shank member 71 and extends laterally therefrom in diametrically opposing directions. Cross arm member 77 is spaced apart from end member 56 and is disposed in a parallel plane thereto. Members 76 and 77 are generally of a body sections having uniform cross sectional thickness that are circular in plane view and equal in length. Shank member 71 has an axial protuberance comprised of a short longitudinal member 78 which depends longitudinal from the surface of shank 31 and directly opposite from the center of the horizontal and vertical axis of cross arm member 77.

Figure 8:
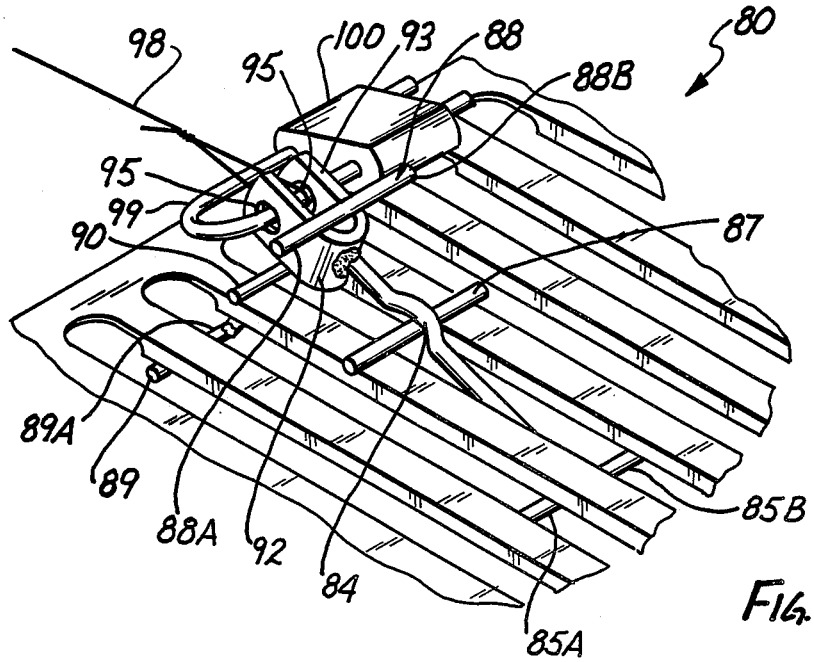
FIG. 8 is still another mooring device, which is also constructed in accordance with the present invention, and which is shown disposed between the bars of a grate and locked in place by a lock.
Figure 9:
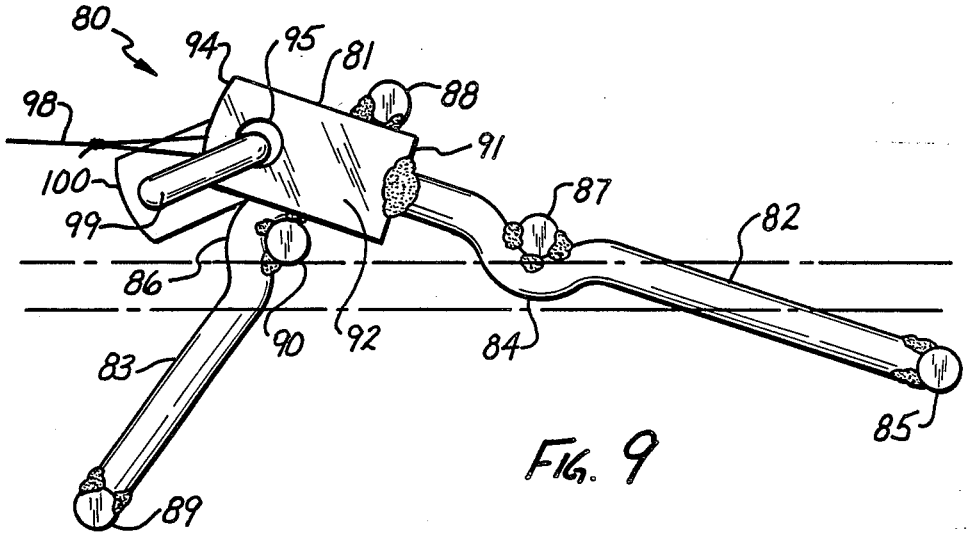
FIG. 9 is an enlarged elevation view of the device depicted in FIG. 8.

As shown in FIGS. 8 and 9, there is shown a boat mooring device 80 constructed in accordance with the present invention In this construction, the boat mooring device 80 is a two part construction and enables the device 70 to be used with a lock 100 to lock the device 70 to a fixed stationary structure, such as the illustrated grating. One part is generally similar to the device 10 of FIG. 1, and thus can be used for all of the same non-locking applications as previously described, includes a first shank member 82 with an axial protuberance 84 thereon and having at one end a U-shaped yoke 81 and at the opposite end an outer cross arm member 85 having a pair of elongated outer arms 85A and 85B extending in diametrically opposing directions. Disposed centrally to the axial protuberance 84, a cross arm member 87 is fixed to the surface of shank member 82 and extends laterally therefrom in a parallel plane to the outer arm sections 85A and 85B.

As shown in FIGS. 8 and 9, the boat mooring device 80 further includes a second shank member 83 with an axial protuberance 86 thereon and having two elongated cross arm members 88 and 89 disposed on opposite ends of the shank member 83 forming a pair of inner arm sections 88A and 88B and a pair of outer arm sections 89A and 89B that extend laterally and in diametrically opposing directions from the shank member 83. Disposed centrally to the axial protuberance 86, a cross arm member 90 is fixed to the surface of shank member 83 and extends centrally therefrom in a parallel plane to the outer arm section 89A and 89B.

Considering now the boat mooring device 80 in greater detail with reference to FIGS. 8 and 9, the first shank member 82 is generally a body section of uniform cross sectional thickness that is circular in plane view Disposed on one end of the shank member 82 is a U-shaped yoke member 81 having a base 81A which depends from the terminal end of shank member 82. Yoke member 81 is generally a U-shaped body section of uniform cross sectional thickness having a base section 91 and a pair of equally spaced side walls 92 and 93 projecting generally upwardly and perpendicularly from the base terminating in a rim 94. Each side wall 92 and 93 has a hole 95 which is spaced closer to rim 94 than base 91. The distance between the opposing inner surfaces of yoke member 81 is less than the longitudinal length of members 89 and 90 but greater than the thickness of the second shank member 83 so that shank member 83 may be received into and easily cradled by yoke member 81.

Each one of the side walls 92 and 93 of yoke member 81 are similar to one another and only sidewall 92 will now be described. Referring to FIG. 9, side wall 9 is generally rectangular in side view and extends periodically from base 91 and terminates in a rim 94. The distance from the inner surface of base 91 to the circumferential edge of hole 95 is spaced a distance greater than height of protuberance 86 so that protuberance will not obstruct holes 95 in sidewalls 92 and 93. The width of side wall 92 is greater than the distance between the opposing inner surfaces of inner arm sections 88A and 88B and the inner surface of cross arm member 90 so that side walls 92 will slide between these inner surfaces as shank member 83 is received into and cradled by yoke 81. Holes 95 are adapted to receive either a mooring line 98 or an arm or shank 99 of a lock 100, which may be a conventional padlock. Other types of locks may also be employed Referring now to FIG. 8, the operation of the present invention will now be described. In use, the mooring device 80 of the present invention is separated into two respective parts. First shank member 82 is held directly above the space 101 between adjacent planks or grates 100 and 102 and then lowered until outer cross arm member B5 is below the lower surface of grates 100 and 102 and center cross member 87 is above the upper surface of grates 100 and 102. The mooring device 80 is then rotated 90° about its axis so that cross member 85 extends transversely across the lower surfaces of grates 100 and 102 and cross member 87 extends across the upper surface of grates 100 and 102 thereby allowing the first anchor member 80A to rest on the grating when released. A similar procedure is followed with the second anchor member by holding the second shank member 83 directly above the space 101 between adjacent grates 100 and 102 and then rotating the shank member 83 so that cross arms 89 can slide between the two grates 100 and 102. Shank member 83 is then lowered until cross member 89 is below the lower surface of grates 100 and 102 and the center cross member 90 is above the upper surface of grates 100 and 102. The shank member 83 is then rotated about its axis so that member 89 extends transversely across the lower surface of grates 100 and 102 and cross member 90 extends transversely across the upper surface of grates 100 and 102. The second anchor member is then aligned with the first anchor member so shank member 83 can be received into yoke 81 by sliding the yoke between the inner surfaces of cross arm member 88 and 90 and brought to resting arrangement against the base 91 of yoke 81. In this manner, cross arm 88 and 90 are detachably secured against the terminal surfaces of sidewalls 92 and 93, while both cross arm 87 and cross arm 90 transversely rest across the upper surfaces of grates 100 and 102 forming a rigid stationary mooring station on the grating A mooring line attached to a boat may then be looped through holes 95 to secure a boat to the device or alternatively, for greater security a mooring line cable may be attached to the arm 99 of a lock 100 which extends through holes 95 and is brought into locking engagement with the lock 100.

The mooring device of the present invention can be made in various sizes and of various materials, including plastic or metal. The form shown in the drawings is preferably molded of a non-corrosive metal and the various elongated members thereof have a transverse width and thickness of about one-half inch to adapt the device for convenient use with a pier structure having the planking members spaced between $\frac{5}{8}$ to 1 inch apart. When the planking members are spaced more than 1 inch apart the various members may be increased accordingly to accommodate the greater spacing. As shown in the drawing each of the perpendicular members 13, 15 and 17 are about four inches long. Members 13 and 14 are spaced apart about four inches and members 13 and 17 are spaced apart about 1 $\frac{1}{8}$ inches.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A boat mooring device comprising:

a shank member, said shank member being a rod;

a first cross arm member perpendicular to said shank member and disposed on one end thereof;

a second cross arm member perpendicular to said shank member and oppositely disposed said first cross arm member extending from the opposite end of said shank member;

a third cross arm member perpendicular to said shank member and disposed in a parallel spaced-apart manner from said first cross arm member and said second cross arm member;

said third cross arm member being disposed closer to said first cross arm member than said second cross arm member;

said first, second, and third cross arm members each being a rod and being attached to said shank member at their central portions;

said first cross arm member being adapted for attaching a mooring line thereto when said second cross arm member is inserted into a retaining slot formed by planks of one thickness; and said second cross arm member being adapted to engage a mooring line when said first cross arm member is inserted into a retaining slot formed by planks of a greater thickness.

2. A boat mooring device as in claim 1, further including an axially extending protuberance on said shank member for engaging and frictionally gripping a fixed stationary support surface to help prevent relative movement therebetween.

3. A boat mooring device as in claim 1 wherein said first, second, and third cross arm members each have a transverse width dimensioned to permit said members to pass between a pair of spaced apart plank members forming part of the walkway of a pier; and wherein said third cross arm member and said second cross arm member have oppositely disposed surfaces which are spaced at the outer ends thereof a distance greater than the thickness of said plank members.

4. A boat mooring device comprising:

a first shank member with an axial protuberance thereon and having at one end thereof, yoke means for receiving a second shank member;

a pair of oppositely disposed elongated outer arm means extending from the opposite end thereof in diametrically opposing directions;

a cross arm section perpendicularly aligned with said axial protuberance spaced from said outer arm means and extending laterally therefrom in a parallel plane to said outer arm means;

a second shank member with an axial protuberance thereon, having a pair of outer arm means at one end thereof for attaching a mooring line;

a pair of oppositely disposed elongated inner arm means extending from the opposite end thereof in diametrically opposing directions; and a cross arm section perpendicularly aligned with said axial protuberance spaced from said outer arm means and extending laterally therefrom in a parallel plane to said outer arm means.

5. A boat mooring device comprising:

a first shank member with an axial protuberance thereon and having at one end thereof, yoke means for receiving a second shank member;

a pair of oppositely disposed elongated outer arm means extending from the opposite end thereof in diametrically opposing directions;

a cross arm section perpendicularly aligned with said axial protuberance spaced from said outer arm means and extending laterally therefrom in a parallel plane to said outer arm means;

a second shank member with an axial protuberance thereon, having a pair of outer arm means at one end thereof for attaching a mooring line;

a pair of oppositely disposed elongated inner arm means extending from the opposite end thereof in diametrically opposing directions; and a cross arm section perpendicularly aligned with said axial protuberance spaced from said outer arm means and extending laterally therefrom in a parallel plane to said outer arm means; and wherein the yoke means has side walls having oppositely disposed surfaces which are spaced apart a distance greater than the thickness of said second shank member.

6. A boat mooring device as in claim 5, wherein said axial protuberance of said first shank member is a rod.

7. A boat mooring device as in claim 5, wherein said axial protuberance of said first shank member is a bent portion in said first shank member.

8. A boat mooring device as in claim 5, wherein said axial protuberance of said second shank member is a rod.

9. A boat mooring device as in claim 5, wherein said axial protuberance of said second shank member is a bent portion in said second shank member.

10. A mooring device recited in claim 5, wherein the site walls have oppositely disposed surfaces which are spaced apart a distance greater than the thickness of said second shank member.

11. A boat mooring device as in claim 5, further comprising:

locking means for receiving a mooring line cable and for locking said first shank member into locking engagement with said second shank member when said second shank member is received within said yoke means of said first shank member.

12. A mooring device as recited in claim 11, wherein said locking means is a padlock having a pivoted U-shaped link adapted to receive a mooring line cable and to pass through the holes of said U-shaped bracket.

13. A method of securing a mooring cable comprising:

using a mooring device including a shank member, said shank member being a rod; a first cross arm member perpendicular to said shank member and disposed on one end thereof; a second cross arm member perpendicular to said shank member and oppositely disposed said first cross arm member extending from the opposite end of said shank member; a third cross arm member perpendicular to said shank member and disposed in a parallel spaced-apart manner from said first cross arm member and said second cross arm member; said third cross arm member being disposed closer to said first cross arm member than said second cross arm member; said first, second, and third cross arm members each being a rod and being attached to said shank member at their central portions; said first cross arm member being adapted for attaching a mooring line thereto when said second cross arm member is inserted into a retaining slot formed by planks of one thickness; and said second cross arm member being adapted to engage a mooring line when said first cross arm member is inserted into a retaining slot formed by planks of a greater thickness;

holding the first shank member above the space between adjacent planking members with the outer and inner arms thereof parallel to said planking member surfaces;

sliding the first shank member through and between the space between said planking members until the outer arm member extends below the lower surface of said planking members;

rotating said first shank member 90° so that the outer arm sections and the inner arm sections extend perpendicular for the longitudinal axis of the planking members;

holding the second shank member above the space between adjacent planking member with the outer, inner and cross arms thereof parallel to said planking member surfaces;

sliding the second shank member through and between the space between said planking members until the outer arm member extends below the lower surface of said planking member;

rotating said second shank member 90° so that the outer arm sections and the cross arm sections extend perpendicular to the longitudinal axis of the planking member;

mounting the second shank member into said yoke means on said first shank member;

attaching a mooring cable to a locking means; and affixing said locking means to said yoke means to lock said first shank member and said second shank member together.

* * * * *

UNITED STATES PATENT AND TRADEMARK OFFICE

CERTIFICATE OF CORRECTION

PATENT NO. : 4,899,680

DATED : February 13, 1990

INVENTOR(S) : Alexander I. Russell, Jr.

It is certified that error appears in the above-identified patent and that said Letters Patent is hereby corrected as shown below:

Column 1, line 43, after "threads", insert --.--.

Column 1, line 46, after "achieved", insert --.--.

Column 1, line 50, after "planks", insert --.--.

Column 2, line 11, after "sections", insert --.--.

Column 3, line 6, after "members", insert --.--.

Column 3, line 61, after "structures", insert --.--.
Column 5, line 2, after "employed", insert --.--.
Column 5, line 34, after "14", insert --.--.
Column 7, line 37, after "invention", insert --.--.
Column 7, line 68, after "view", insert --.--.
Column 8, line 33, after "employed", insert --.--.

Column 8, line 40, after "member", delete "B5", and substitute therefor --85--.

Column 9, line 3, after "grating", insert --.--.
Column 10, line 64, before "walls", delete "site", and substitute therefor --side--.

Signed and Sealed this

Fourteenth Day of May, 1991

*Attest:*

HARRY F. MANBECK, JR.

*Attesting Officer*

*Commissioner of Patents and Trademarks*